US008814144B2

(12) United States Patent
McTaw, Jr.

(10) Patent No.: US 8,814,144 B2
(45) Date of Patent: Aug. 26, 2014

(54) AIR REGISTER ASSEMBLY

(75) Inventor: Johnnie McTaw, Jr., Farmington Hills, MI (US)

(73) Assignee: Johnnie McTaw, Jr., Farmington Hills, MI (US)

( * ) Notice: Subject to any disclaimer, the term of this patent is extended or adjusted under 35 U.S.C. 154(b) by 1175 days.

(21) Appl. No.: 12/756,616

(22) Filed: Apr. 8, 2010

(65) Prior Publication Data

US 2011/0250834 A1 Oct. 13, 2011

(51) Int. Cl.
*F24F 7/00* (2006.01)
*F24F 13/08* (2006.01)

(52) U.S. Cl.
CPC ..... *F24F 13/085* (2013.01); *F24F 2013/088* (2013.01)
USPC ..... 254/330; 55/487

(58) Field of Classification Search
USPC ..... 454/280, 271, 284, 330; 96/121, 134, 96/131, 136; 55/490, 492, 502, 509, 507, 55/513
See application file for complete search history.

(56) References Cited

U.S. PATENT DOCUMENTS 2,881,854 A * 4/1959 Uehre, Jr. ..... 96/138
3,252,580 A * 5/1966 Getzin ..... 210/485
3,494,113 A * 2/1970 Kinney ..... 55/481
3,626,668 A * 12/1971 Cardiff ..... 6/58
3,740,934 A * 6/1973 Shuler ..... 55/490
3,938,430 A 2/1976 Koppang
4,088,463 A * 5/1978 Smith ..... 55/480
4,334,899 A * 6/1982 McConnell ..... 55/321
4,626,265 A * 12/1986 Adiletta ..... 96/135
4,629,479 A * 12/1986 Cantoni ..... 96/55
5,176,570 A * 1/1993 Liedl ..... 454/309
5,221,520 A * 6/1993 Cornwell ..... 422/122
5,332,409 A * 7/1994 Dralle ..... 55/484
5,423,903 A * 6/1995 Schmitz et al. ..... 96/134
5,525,145 A * 6/1996 Hodge ..... 96/17
5,597,392 A 1/1997 Hawkins et al.
5,690,719 A * 11/1997 Hodge ..... 96/17
5,863,310 A * 1/1999 Brown et al. ..... 55/480
6,156,089 A * 12/2000 Stemmer et al. ..... 55/467
6,241,794 B1 * 6/2001 Jadran et al. ..... 55/490
6,371,846 B1 4/2002 Powell et al.
6,422,935 B1 7/2002 Yampolski
6,506,113 B2 1/2003 Berger
6,623,540 B2 * 9/2003 Clayton et al. ..... 55/480
6,797,028 B2 * 9/2004 Duffy ..... 55/385.2
6,814,660 B1 * 11/2004 Cavett ..... 454/284
6,913,637 B2 * 7/2005 Kim ..... 95/8
6,942,710 B2 * 9/2005 Milano ..... 55/480
7,364,602 B2 * 4/2008 Wu et al. ..... 55/493
7,811,346 B1 * 10/2010 Henson ..... 55/385.1

(Continued)

*Primary Examiner* — Steven B. McAllister
*Assistant Examiner* — Frances H Kamps
(74) *Attorney, Agent, or Firm* — Quinn Law Group, PLLC

(57) ABSTRACT

An air register assembly is adapted to be inserted into a forced air duct, and configured to streamline then mix airflow in the duct. The assembly includes a face-plate having a vent, a frame attached to the face-plate and arranged to extend into the duct. The assembly additionally includes a plurality of mounts arranged on the frame, and a first and second mesh panels configured to be selectively inserted into, and removed from the frame. When the first and second mesh panels are inserted into the frame, the panels are supported by the mounts, the first panel is disposed between the face-plate and the second panel, and each of the first and second mesh panels is positioned substantially perpendicular to the airflow.

16 Claims, 4 Drawing Sheets

(56) References Cited

U.S. PATENT DOCUMENTS 7,993,589 B1 * 8/2011 Shigemoto et al. ..... 422/122
2006/0086252 A1 * 4/2006 Huang ..... 96/134
2010/0101197 A1 * 4/2010 Livingstone et al. ..... 55/356

* cited by examiner

AIR REGISTER ASSEMBLY

TECHNICAL FIELD

The invention relates to air registers, and, in particular, to an air register assembly for a forced air duct.

BACKGROUND OF THE INVENTION

A typical building employs a heating and ventilation system for controlling a temperature within the subject structure. Often such heating and ventilation systems employ a forced air system for distributing temperature-controlled air throughout the subject structure.

In the forced air approach, centralized heating and air conditioning units are typically employed as the mechanism behind the distribution of temperature-controlled air inside a building. Specifically configured ductwork, along with various vents and plenums, is operatively connected to the heating and air conditioning units, and is employed to distribute a flow of air throughout the building. Such ductwork generally utilizes a multitude of branches, and each branch typically terminates at an air register that includes vents adapted to release the air inside the building.

Air registers are known to have moveable or adjustable vents in an effort to control the amount and direction of airflow out of the duct. An air register may also be provided with a decorative design, in an effort to provide a pleasing appearance to an otherwise merely functional device.

SUMMARY

An air register assembly is adapted to be inserted into a forced air duct, and configured to streamline and mix airflow in the duct. The assembly includes a face-plate having a vent and a frame attached to the face-plate that is arranged to extend into the duct. The assembly additionally includes a plurality of mounts arranged on the frame, and a first and second mesh panels configured to be selectively inserted into, and removed from the frame. When the first and second mesh panels are inserted into the frame, the panels are supported by the mounts, the first panel is disposed between the face-plate and the second panel, and each of the first and second mesh panels is positioned substantially perpendicular to the airflow.

At least some of the plurality of mounts may be configured from a compliant material. At least some of such mounts may include stand-off ribs, such that when the first and second panels are inserted into the frame, the ribs deform to provide a tight fit and support for the panels within the respective mounts.

The assembly may also include a filter adapted to be inserted into either the face-plate or the frame, such that when the filter is inserted, the filter is positioned substantially perpendicular to the airflow. The face-plate may be characterized by first and second substantially parallel surfaces, with the vent extending through the first and second surfaces, while the filter may be inserted into the face-plate between the first and second surfaces.

The face-plate may include a plurality of apertures extending through each of the first and second surfaces, and a plurality of fasteners. Each aperture may be configured to accept one of the plurality of fasteners for fixing the face-plate relative to the forced air duct, and at least one of the plurality of fasteners may be adapted to retain the filter in the face-plate.

Each of the first and second panels may include a first set of apertures and a second set of apertures, such that when the first and second panels are inserted into the frame, the first set of apertures of the first panel substantially aligns with the first set of apertures of the second panel. The second set of apertures of the first panel may be configured to not align with the second set of apertures of the second panel when the first and second panels are inserted into the frame.

The apertures of the first sets of the first and second panels may be characterized by substantially same size and shape, and the apertures of the second set of the first panel are dissimilar from the apertures of the second set of the second panel in at least one of size and shape.

The frame may include a first set of cut-outs for permitting a first panel to be inserted into the frame and a second set of cut-outs for permitting the second panel to be inserted into the frame. At least some of the plurality of mounts may be aligned with the first set of cut-outs, and at least some of the other of the plurality of mounts may be aligned with the second set of cut-outs.

A method for streamlining and mixing airflow in a forced air duct by installing the air register assembly described above into the forced air duct is also disclosed.

The above features and advantages and other features and advantages of the present invention are readily apparent from the following detailed description of the best modes for carrying out the invention when taken in connection with the accompanying drawings.

DETAILED DESCRIPTION

Figure 1:
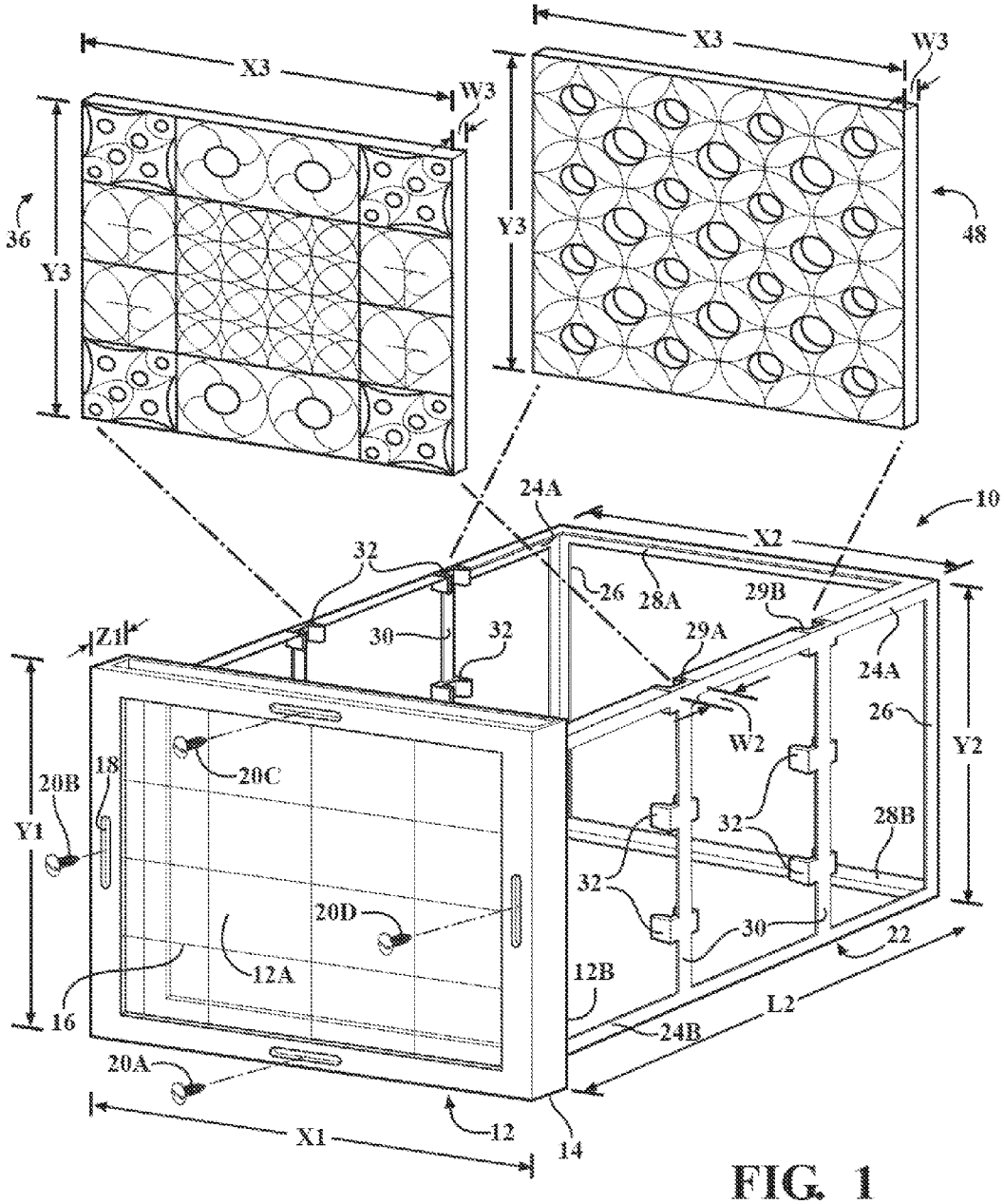
FIG. 1 is a perspective view of an air register assembly, i.e., Diverzer, with a first and second drop-in mesh panels shown ready for insertion.

Referring to the drawings, wherein like reference numbers refer to like components, FIG. 1 shows a Diverzer 10. The Diverzer 10, as used herein, represents an air register assembly that is adapted to be inserted into a forced air duct (not shown) of a heating and ventilation system inside a building structure, as understood by those skilled in the art. Thus installed, Diverzer 10 is configured to streamline and mix a flow of air that is moved through the air duct before the air is released inside the subject building structure.

Diverzer 10 includes a face-plate 12 having a perimeter frame 14 and a vent 16. Face-plate 12 is characterized by a first surface 12A adapted to be (visually perceived by) visible to an occupant of the building structure, when the Diverzer 10 is installed inside the air duct. Additionally, face-plate 12 is characterized by a second surface 12B adapted to be seated against a wall (not shown) of the building structure when the Diverzer 10 is inserted in the forced air duct. Vent 16 extends through each of the first and second surfaces 12A, 12B thus permitting the air to flow through the face-plate 12. First and second surfaces 12A and 12B are disposed substantially parallel relative to each other, while an open space is created there between. First surface 12A, being the visible part of the Diverzer 10, is also configured as a grille to display a decorative or ornamental design.

Face-plate 12 is characterized by a width X1, a height Y1, and a length or depth Z1. Width X1 and height Y1 are selected to be larger than the respective width and height dimensions of an opening in the wall through which the Diverzer 10 is to be inserted, as understood by those skilled in the art. Thus, when the Diverzer 10 is inserted through the opening in the wall and into the forced air duct, the opening in the wall will be completely covered by the face-plate 12. Perimeter frame 14 includes apertures 18, shown as slots, extending there through, substantially orthogonally to the first and second surfaces 12A and 12B. Apertures 18 are adapted to accept appropriate fasteners 20A-D, such as screws, for fixing the Diverzer 10 to the wall, with respect to the air duct. Although four apertures 18 together with four respective fasteners 20A-D are shown, nothing precludes the use of a smaller or a greater number of such apertures and fasteners.

A ladder frame 22 is attached to the face-plate 12. Ladder frame 22 is characterized by a width X2, a height Y2, and a length L2. Width X2 and height Y2 dimensions each are smaller than the respective width X1 and height Y1 of the perimeter frame 14, and are additionally selected such that ladder frame 22 may be inserted through the respective opening in the wall. Ladder frame 22 includes two upper elongated rails 24A and two lower elongated rails 24B, two upright posts 26, and one upper horizontal beam 28A and one lower horizontal beam 28B. Each rail 24A and 24B is attached at one end to the face-plate 12, and is also attached at the other end to a respective post 26, wherein one upper rail 24A and one lower rail 24B are attached to opposite ends of one respective post 26.

Each upper rail 24A and lower rail 24B is additionally attached to an upper beam 28A and to a lower beam 28B, respectively. The ladder frame 22 may be constructed from a variety of materials, such as metal or plastic, and be held together by any appropriate known method, such as welding and/or fastening. The length L2 is sufficiently great to permit each upper rail 24A to include at least two cut-outs 29A and 29B. Each cut-out 29A, 29B is characterized by a width W2. Each cut-out 29A in rails 24A is disposed directly across from the other cut-out 29A, while each cut-out 29B is disposed directly across from the other cut-out 29B, such that each pair of cut-outs 29A and 29B forms a respective slot with respect to frame 22.

Figure 3A:
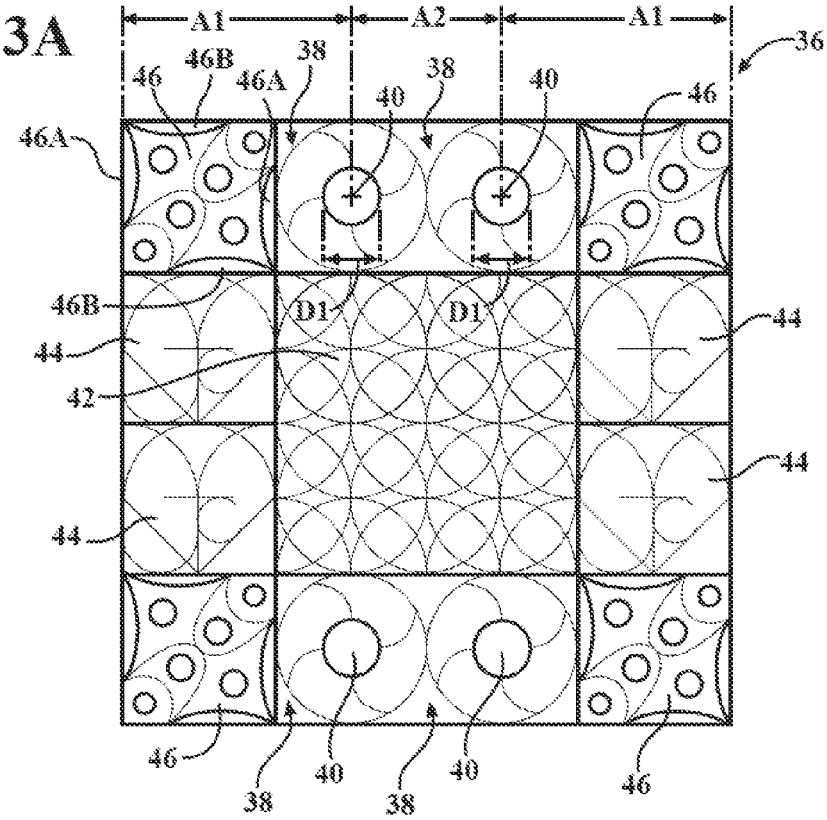
FIG. 3A is a close-up elevational view of the first drop-in mesh panel shown in FIG. 1.

Frame 22 additionally includes several upright supports 30. Each support 30 is attached to one upper and one lower rail 24, at an intermediate distance between face-plate 12 and posts 26, along the length L2. Three mounts 32 are fixed on each support 30, one mount directly below the other. Each mount 32 is formed from an appropriate compliant material, such as rubber, to provide a tight fit and stability for a first drop-in mesh panel 36 and a second drop-in mesh panel 48, that are each capable of being selectively inserted into, retained in, and removed from ladder frame 22. First and second drop-in mesh panels 36, 48 will be described with respect to FIGS. 3A and 3B in greater detail below.

Figure 2A:
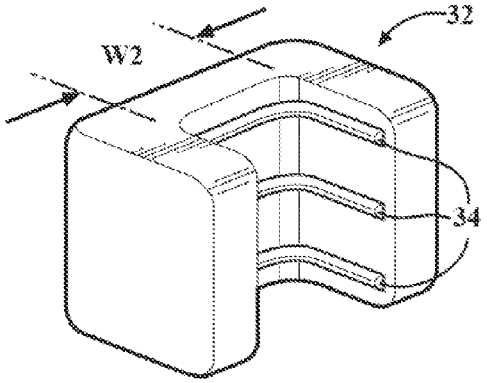
FIG. 2A is a close-up perspective view of a mount.
Figure 2B:
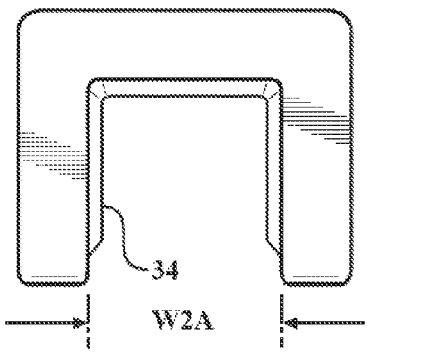
FIG. 2B is a top view of the mount shown in FIG. 2A.

As shown in FIGS. 2A and 2B, each mount 32 includes a plurality of elastically deformable ribs 34 that are provided to further aid in the retention and control of vibration of the drop-in mesh panels 36 and 48. Although three mounts 32 are shown on each support 30 in FIG. 1, nothing precludes the use of a fewer or a greater number of such mounts per support 30. Viewed from the top, as shown in FIG. 2B, each mount 32 has a general "C" shape. Each mount 32 is characterized by a width W2A at the mouth of the "C", not including the thickness of ribs 34. Width W2A is preferably either substantially equal to width W2 of the cut-outs 29, or is slightly narrower. When positioned on frame 22, mounts 32 are vertically aligned with cut-outs 29 such that drop-in mesh panels 36, 48 may be conveniently inserted into the frame. For additional structural support, as understood by those skilled in the art, mounts 32 may be encased on the outer perimeter of the "C" in a rigid sheath material (not shown), such as an appropriate plastic or metal, while still, at the very least, keeping ribs 34 exposed.

Figure 3B:
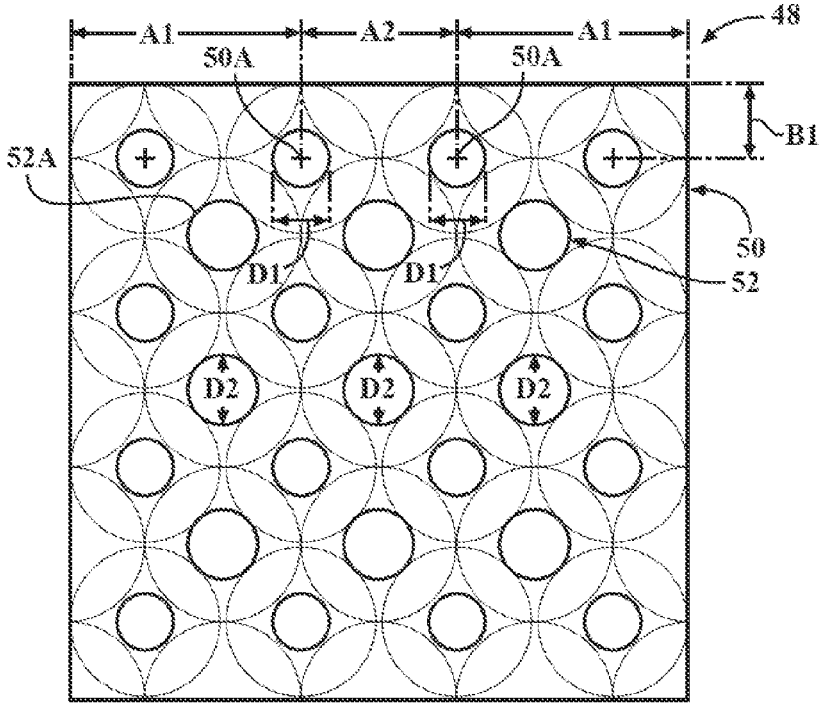
FIG. 3B is a close-up elevational view of the second drop-in mesh panel shown in FIG. 1.

As mentioned above, FIG. 3A depicts a first drop-in mesh panel 36 provided for insertion into slots defined by cut-outs 29A and through mounts 32, while FIG. 3B depicts a second drop-in mesh panel 48 provided for insertion into slots defined by cut-outs 29B. Each mesh panel 36 and 48 is characterized by width X3, a height Y3, and a thickness W3. Each of the dimensions X3, Y3, and W3 is by design slightly smaller than the respective dimensions X2, Y2, and W2 in order to facilitate insertion and retention of mesh panels in frame 22. Thus, when mesh panels 36 and 48 are inserted into their respective slots, the mesh panels are retained inside ladder frame 22, with mesh panel 48 disposed directly behind mesh panel 36.

Mesh panel 36 includes a first-type of mesh area 38. Mesh area 38 includes apertures 40 having a diameter D1. Mesh area 38 is shown as being present in four separate locations of mesh panel 36. The center of each aperture 40 is located at a distance "A1" from the horizontal edge of panel 36, and a distance "B1" from the nearby vertical edge of the subject panel, while the centers of adjacent apertures 40 are located at a distance "A2" from each other. Mesh panel 36 also includes a second type of mesh area of 42. Mesh area 42 is a characterized by a mesh that has various separate openings, each of which generally has a smaller size than does each aperture 40. Furthermore, mesh area 42 is stylized in an effort to provide a pleasing, decorative appearance to mesh panel 36. Mesh panel 36 additionally includes a third type of mesh area 44, that is also stylized, such as with etched initials or trademark of the inventor or manufacturer, to provide a decorative appearance to mesh panel 36. Mesh panel 36 also includes a fourth type of mesh area 46. Mesh area 46 is characterized by a mesh that includes two slots 46A and two slots 46B. Slots 46A and slots 46B may either have similar or dissimilar dimensions.

As shown in FIG. 3B, mesh panel 48 includes a mesh having a repeating pattern that alternates a first-type row of apertures 50 and a second-type row of apertures 52. Row of apertures 50 includes apertures 50A characterized by a diameter D1, while row of apertures 52 includes apertures 52A characterized by a diameter D2. Diameter D2 is preferably larger than diameter D1. Thus, apertures 50A of mesh panel 48 purposefully have the same diameter D1 as do apertures 40 of mesh panel 36. The center of each aperture 50A is located at a distance "A2" from each adjacent aperture 50A, and a distance "B1" from the nearby vertical edge of the subject panel, while each of the two apertures 50A at the center of each row is located at a distance "A1" from the horizontal edge of panel 48. Hence, the two apertures 50A at the center of the top row and the two apertures 50A at the center of the bottom row are located at the same positions with respect to mesh panel 48 as the four apertures 40 are located with respect to mesh panel 38.

When mesh panels 36 and 48 are inserted into the corresponding slots defined by cut-outs 29A and 29B, mesh panel 36 is disposed between face-plate 12 and mesh panel 48, and each of the mesh panels is positioned substantially perpendicular to the airflow. Additionally, when both mesh panels are thus installed, four of the apertures 50A are disposed directly behind the four apertures 40. In particular, the two apertures 50A at the center of the top row and the two apertures 50A at the center of the bottom row of mesh panel 48 are aligned with apertures 40 of mesh panel 38. Because apertures 50A and apertures 40 are each characterized by diameter D1, air flowing through the forced air duct toward vent 16 passes through apertures 50A disposed directly behind apertures 40 largely unimpeded. At the same time, the air flowing through the other apertures of mesh panel 48 encounter apertures having dimensions and shape that is different than those of mesh panel 36, which generates turbulence in the flow of air and subsequent mixing. Accordingly, the air moved through the air duct before the air is released inside the subject building structure is streamlined by apertures 50A and 40. Additionally, the air is moved through the duct and is thoroughly mixed by virtue of mesh panels 36 and 48 lacking any other substantially similar apertures situated directly behind one another.

Figure 4:
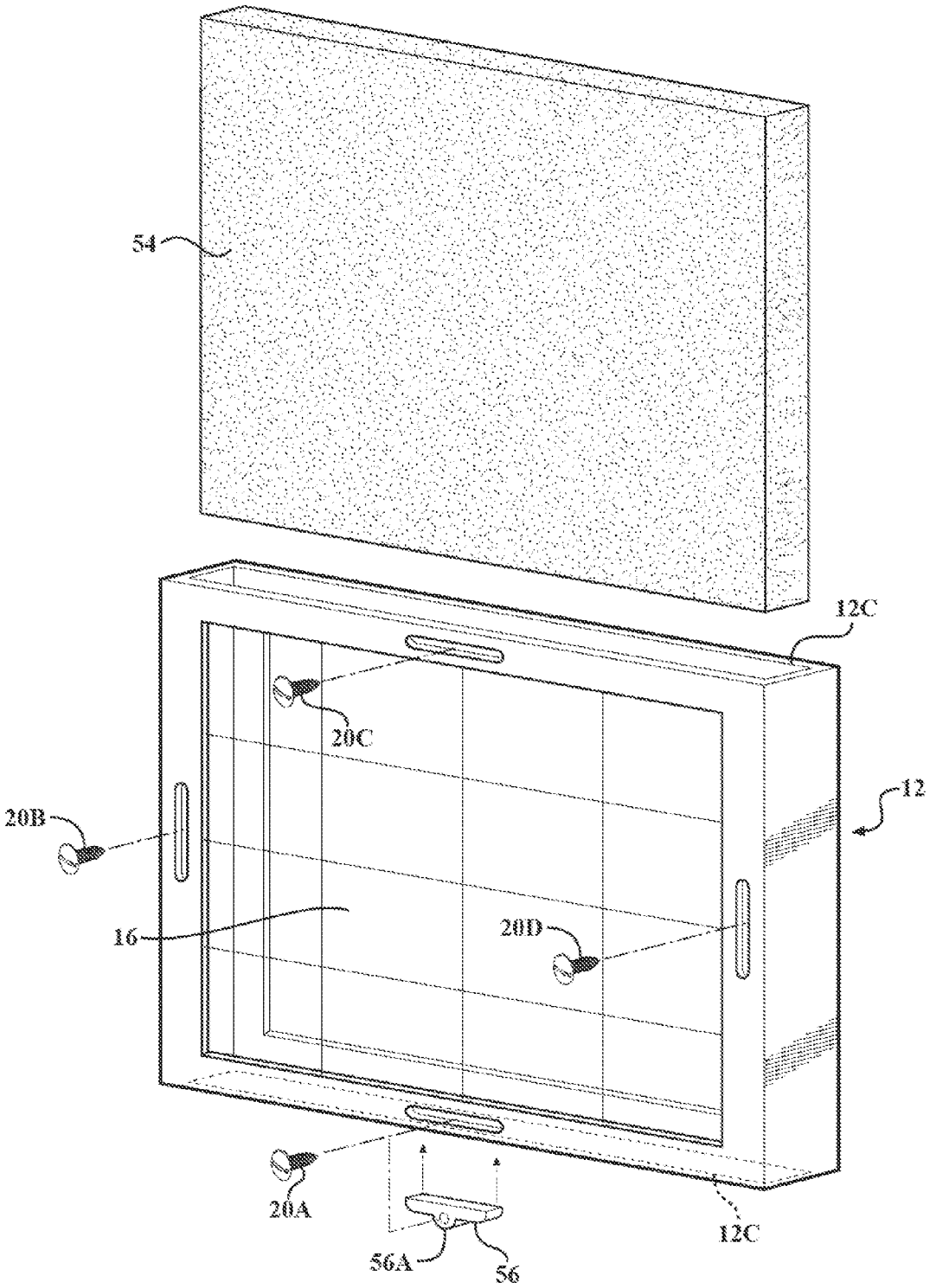
FIG. 4 is a face-plate having a slot with a filter adapted for insertion into and retention inside the face-plate of the air register assembly shown in FIG. 1.

As shown in FIG. 4, to aid with filtering of the air being moved through the Diverzer 10, face-plate 12 includes a slot 12C configured to accept a drop-in or insertable filter 54. Filter 54 slots in between first and second surfaces 12A, 12B thus being positioned substantially perpendicular to the airflow which passes through the face-plate 12. Fasteners 20A-D are additionally located to retain filter 54 inside the face-plate 12 by providing hard stops and/or movement limit for the filter, when the fasteners are in position to fix the Diverzer 10 to the wall. Slot 12C may extend from top to bottom of face-plate 12, such that filter may be inserted either from the bottom of the face-plate or from the top.

A stopper 56 may be provided at the location of the bottom fastener 20A. Stopper 56 is adapted to accept fastener 20A through an aperture 56A, such that the stopper is retained inside the face-plate by the subject fastener when fastener 20A is inserted into the face-plate. Stopper 56 provides an increased contact area for the filter 54 to rest on, as compared to the diameter of fastener 20A, when the filter is in place within the face-plate 12. Although not shown, but as understood by those skilled in the art, frame 22 may also be configured to accept filter 56 with an arrangement described above for the mesh panels 36 and 48. In such a case, the filter 54 would preferably be positioned in frame 22 between face-plate 12 and mesh panel 36.

Figure 5:
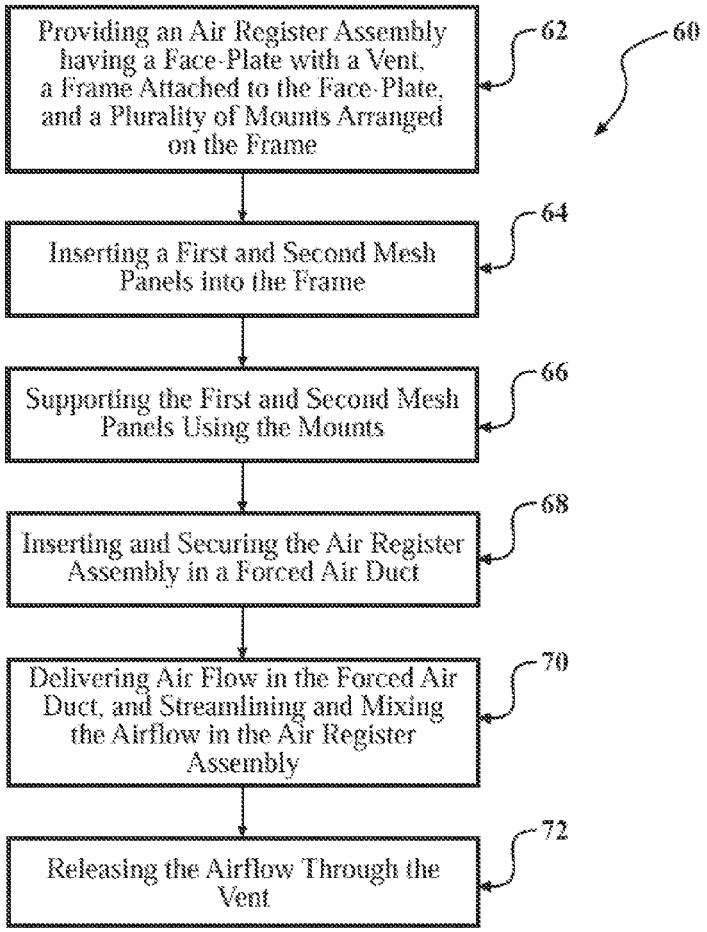
FIG. 5 is a flow chart illustrating a method for streamlining and mixing airflow in a forced air duct by using the air register assembly depicted in FIG. 1.

A method 60 for streamlining and mixing airflow in a forced air duct is shown in FIG. 5, and described below with respect to FIGS. 1-3. The method commences in frame 62, where the Diverzer 10 having face-plate 12 with vent 16, ladder frame 22 attached to the face-plate and arranged to extend into the forced air duct, and mounts 32 arranged on the ladder frame is provided. Following frame 62, the method continues to frame 64, where first and second mesh panels 36 and 48 are inserted into the ladder frame 22. The inserted mesh panels 36 and 48 are positioned such that the first panel 36 is disposed between the face-plate 12 and the second panel 48, and each of the first and second mesh panels is positioned substantially perpendicular to the airflow. After frame 64, the first and second mesh panels are supported by the mounts 32 in frame 66. After frame 66, the method proceeds to frame 68, where Diverzer 10 is inserted into the forced air duct, and is secured in the forced air duct via fasteners 20. Then, the method moves to frame 70, where the airflow is delivered into the forced air duct, and is streamlined and mixed in the Diverzer 10. The method concludes in frame 72, where the airflow is released through the vent 16.

While the best modes for carrying out the invention have been described in detail, those familiar with the art to which this invention relates will recognize various alternative designs and embodiments for practicing the invention within the scope of the appended claims.

The invention claimed is:

1. An air register assembly adapted to be inserted into a forced air duct and configured to streamline then mix an airflow, the assembly comprising:

a face-plate having a vent;

a frame attached to the face-plate and arranged to extend into the duct;

a plurality of mounts arranged on the frame; and a first and a second mesh panel configured to be selectively inserted into and removed from the frame;

wherein:

when the first and the second mesh panels are inserted into the frame, the mesh panels are supported by the mounts, the first mesh panel is disposed between the face-plate and the second mesh panel, and each of the first and the second mesh panels is positioned substantially perpendicular to the airflow; and each of the first and second mesh panels defines a first set of apertures and a second set of apertures, such that, when the first and the second mesh panel are inserted into the frame, the first set of apertures of the first mesh panel substantially aligns with the first set of apertures of the second mesh panel to thereby streamline the airflow and the second set of apertures of the first mesh panel does not align with the second set of apertures of the second mesh panel to thereby generate turbulence and mix the airflow.

2. The assembly of claim 1, wherein at least some of the plurality of mounts are configured from a compliant material.

3. The assembly of claim 2, wherein the at least some of the plurality of mounts include stand-off ribs, such that when the first and the second mesh panels are inserted into the frame, the ribs deform to provide a tight fit and support for the panels within the respective mounts.

4. The assembly of claim 1, further comprising a filter adapted to be inserted into one of the face-plate and the frame, such that when the filter is inserted, the filter is positioned substantially perpendicular to the airflow.

5. The assembly of claim 4, wherein the face-plate is characterized by substantially parallel first and second surfaces, the vent extends through the first and second surfaces, and the filter is adapted to be positioned between the first and the second surface when the filter is inserted into the face-plate.

6. The assembly of claim 5, wherein the face-plate defines a plurality of apertures extending through the first and the second surface, and a plurality of fasteners, such that each aperture is configured to accept one of the plurality of fasteners for fixing the face-plate relative to the forced air duct, and at least one of the plurality of fasteners is adapted to retain the filter in the face-plate.

7. The assembly of claim 1, wherein the apertures of the first set of apertures of each of the first and the second mesh panel are characterized by substantially same size and shape, and the apertures of the second set of apertures of the first mesh panel are dissimilar from the second set of apertures of the second mesh panel in at least one of size and shape.

8. The assembly of claim 1, wherein the frame includes a first set of cut-outs for permitting the first mesh panel to be inserted into the frame and a second set of cut outs for permitting the second mesh panel to be inserted into the frame, and at least some of the plurality of mounts are aligned with the first set of cut-outs, and at least some of the other of the plurality of mounts are aligned with the second set of cut-outs.

9. A method for streamlining then mixing an airflow, the method comprising:

providing an air register assembly for a forced air duct in order to streamline and mix an airflow via the air register assembly, the air register assembly including:

a face-plate having a vent;

a frame attached to the face-plate and arranged to extend into the forced air duct; and a plurality of mounts arranged on the frame;

inserting a first and a second mesh panel into the frame, wherein each of the first and second mesh panels defines a first set of apertures and a second set of apertures, wherein, when the first and the second mesh panel are inserted into the frame, the first mesh panel is disposed between the face-plate and the second mesh panel, the first and the second mesh panels are each positioned substantially perpendicular to the airflow, the first set of apertures of the first mesh panel substantially aligns with the first set of apertures of the second mesh panel to thereby streamline the airflow and the second set of apertures of the first mesh panel does not align with the second set of apertures of the second mesh panel to thereby generate turbulence and mix the airflow;

supporting the first and the second mesh panel using the mounts;

inserting the air register assembly into the forced air duct;

securing the air register assembly in the forced air duct;

delivering the airflow in the forced air duct and streamlining and mixing the airflow via the air register assembly; and releasing the airflow through the vent.

10. The method of claim 9, wherein at least some of the plurality of mounts are configured from a compliant material.

11. The method of claim 10, further comprising providing a tight fit and support for the first and second panels within the plurality of mounts, wherein at least some of the plurality of mounts include stand-off ribs that are configured to deform when the first and second panels are inserted into the frame.

12. The method of claim 9, further comprising inserting a filter into one of the face-plate and the frame, such that the filter is positioned substantially perpendicular to the airflow for filtering the airflow.

13. The method of claim 12, wherein the face-plate is characterized by substantially parallel first and second surfaces, the vent extends through the first and second surfaces, and said inserting is accomplished by positioning the filter between the first and the second surface of the face plate.

14. The method of claim 13, wherein the face-plate defines a plurality of apertures extending through the first and the second surface, and a plurality of fasteners, such that each aperture is configured to accept one of the plurality of fasteners, further comprising fixing the face-plate relative to the forced air duct by the plurality of fasteners and retaining the filter in the face-plate by at least one of the plurality of fasteners.

15. The method of claim 9, wherein the apertures of the first set of apertures of each of the first and second mesh panels are characterized by substantially same size and shape, and the apertures of the second set of apertures of the first mesh panel are dissimilar from the second set of apertures of the second mesh panel in at least one of size and shape.

16. The method of claim 9, wherein the frame includes a first set of cut-outs for permitting the first mesh panel to be inserted into the frame and a second set of cut outs for permitting the second mesh panel to be inserted into the frame, and at least some of the plurality of mounts are aligned with the first set of cut-outs, and at least some of the other of the plurality of mounts are aligned with the second set of cut-outs.

* * * * *